US011360413B2

(12) United States Patent
Miyake et al.

(10) Patent No.: US 11,360,413 B2
(45) Date of Patent: Jun. 14, 2022

(54) IMAGING SYSTEM

(71) Applicant: Hewlett-Packard Development Company, L.P., Spring, TX (US)

(72) Inventors: Koji Miyake, Yokohama (JP); Satoru Hori, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/282,812

(22) PCT Filed: Sep. 23, 2019

(86) PCT No.: PCT/US2019/052349

§ 371 (c)(1),
(2) Date: Apr. 5, 2021

(87) PCT Pub. No.: WO2020/081192

PCT Pub. Date: Apr. 23, 2020

(65) Prior Publication Data

US 2021/0389698 A1 Dec. 16, 2021

(30) Foreign Application Priority Data

Oct. 19, 2018 (JP) ..... JP2018-197624

(51) Int. Cl.
*G03G 15/16* (2006.01)

(52) U.S. Cl.
CPC ..... *G03G 15/1615* (2013.01); *G03G 15/161* (2013.01); *G03G 2215/00139* (2013.01); *G03G 2215/00616* (2013.01); *G03G 2215/1614* (2013.01)

(58) Field of Classification Search
CPC ..... G03G 15/1615; G03G 15/161; G03G 2215/00139; G03G 2215/00616; G03G 2215/1614
See application file for complete search history.

(56) References Cited

U.S. PATENT DOCUMENTS

| | | | | |
|---|---|---|---|---|
| 6,134,406 | A | 10/2000 | Moe et al. | |
| 9,753,413 | B2 | 9/2017 | Kudo | |
| 9,971,283 | B2 | 5/2018 | Kitago et al. | |
| 2003/0223768 | A1* | 12/2003 | Takigawa | G03G 15/0131 399/66 |
| 2005/0150747 | A1* | 7/2005 | Menendez | B65G 39/16 198/810.03 |
| 2007/0166071 | A1* | 7/2007 | Shima | G03G 15/0131 399/94 |

(Continued)

FOREIGN PATENT DOCUMENTS

| | | | | |
|---|---|---|---|---|
| JP | 2006343629 | A * | 12/2006 | G03G 15/1615 |
| JP | 2012-233976 | A | 11/2012 | |
| WO | WO-2015/008909 | A1 | 1/2015 | |

*Primary Examiner* — Ryan D Walsh
(74) *Attorney, Agent, or Firm* — Jefferson IP Law, LLP

(57) ABSTRACT

An imaging system includes an endless belt, a tensioning system that applies tension to the endless belt, a contact member that engages with the endless belt, and a detector that detects slack at a part of the endless belt. A controller causes the contact member to be separated from the endless belt so that the tensioning system reduces the slack of the endless belt in response to the detector detecting the slack.

19 Claims, 13 Drawing Sheets

(56) References Cited

U.S. PATENT DOCUMENTS

| | | | | |
|---|---|---|---|---|
| 2011/0103815 | A1* | 5/2011 | Hanashi | G03G 15/5058 399/49 |
| 2011/0200343 | A1 | 8/2011 | Matsumoto et al. | |
| 2012/0006215 | A1 | 1/2012 | Dejong et al. | |
| 2013/0016983 | A1* | 1/2013 | Kawakami | G03G 15/0189 399/38 |
| 2016/0259275 | A1 | 9/2016 | Iwakawa et al. | |
| 2017/0275111 | A1 | 9/2017 | Nakajima | |
| 2020/0218194 | A1* | 7/2020 | Ui | G03G 21/0011 |

* cited by examiner

IMAGING SYSTEM

BACKGROUND

In image forming devices which include an intermediate transfer belt for secondarily transferring a toner, an endless belt may be used. The endless belt is engaged with tension rollers, and is driven along a peripheral trajectory.

DETAILED DESCRIPTION

Figure 1:
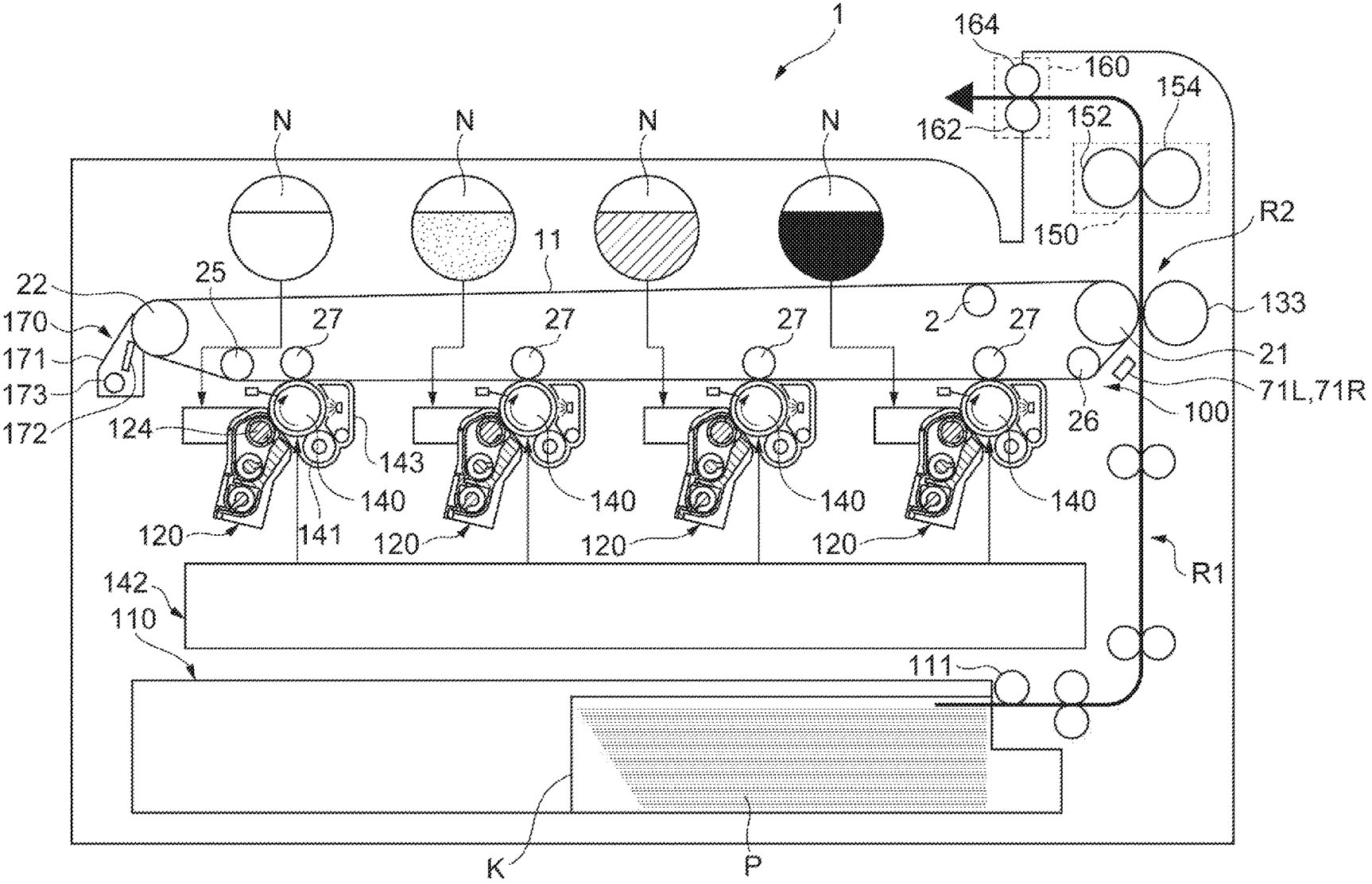
FIG. 1 is a cross-sectional view illustrating a schematic configuration of an example imaging apparatus.

Hereinafter, an example of an imaging system will be described in detail with reference to the accompanying drawings. The imaging system may be an imaging apparatus such as a printer, or a part of the imaging apparatus and the like (for example, a belt drive dive or a developing device). In the following description, with reference to the drawings, the same reference numbers are assigned to the same components or to similar components having the same function, and overlapping description is omitted. In some examples, reference may be made to an XYZ coordinate system including an X-direction, a Y-direction, and a Z-direction which intersect each other as illustrated in the drawings. Furthermore, in a case where the X-direction is set as a width direction, a central portion of the imaging apparatus may be referred to as an inner side and an end of the imaging apparatus may be referred to as an outer side. In addition, the X-direction may be referred to as a right and left direction, the Y-direction may be referred to as a depth direction, and the Z-direction may be referred to as an upper and lower direction.

FIG. 1 is a schematic view of an example imaging apparatus (imaging system) 1 which may be configured to form a color image by using respective colors of magenta, yellow, cyan, and black. The imaging apparatus 1 includes a conveying device 110 that conveys a sheet P that is a recording medium, a developing device 120 that develops an electrostatic latent image, and a belt drive device 100 that functions as a transfer device that secondarily transfers a toner image to the sheet P. Additionally, the imaging apparatus 1 may include an image carrier 140 in which the electrostatic latent image is formed on a surface (peripheral surface) thereof, a fixing device 150 that fixes the toner image to the sheet P, and an ejection device 160 that ejects the sheet P.

The conveying device 110 conveys the sheet P as the recording medium on which an image is formed on a conveying route R1. The sheet P is stacked and accommodated in a cassette K, and is picked up by a paper feeding roller 111 to be conveyed. The conveying device 110 conveys the sheet P to a transfer nip portion R2 through the conveying route R1 at a timing at which the toner image to be transferred to the sheet P arrives at the transfer nip portion R2.

A separate developing device 120 may be provided for each color, e.g., four developing devices 120 associated with four colors. Each of the developing devices 120 includes a developer carrier 124 so that a toner may be carried on an image carrier 140. In the developing device 120, a two-component developer including a carrier, a toner, and an external additive can be used as a developer. In the developing device 120, the carrier, the toner, and the external additive are stirred to adjust the developer. Through the adjustment, the carrier is charged to be positive and the toner is charged to be negative. In addition, the external additive mainly adheres to a surface of the toner.

The developing device 120 may be configured such that the developer is carried on the developer carrier 124. In addition, when the developer is conveyed to a region that faces the image carrier 140 through rotation of the developer carrier 124, the toner in the developer carried on the developer carrier 124 moves to an electrostatic latent image formed on a peripheral surface of the image carrier 140. Due to movement of the toner, the electrostatic latent image is developed, and thus a toner image is formed.

The belt drive device 100 conveys the toner image formed by the developing device 120 to the transfer nip portion R2. The belt drive device 100 includes a transfer belt 11 to which the toner image is initially transferred from the image carrier 140, a drive roller 21, a tension roller 22, and idler rollers 25 and 26 as a suspension roller that suspends the transfer belt 11, and a primary transfer roller 27 that presses or engages the transfer belt 11 in combination with the image carrier 140. Furthermore, the example imaging apparatus 1 includes a secondary transfer roller 133 that presses or engages the transfer belt 11 in combination with the drive roller 21.

The transfer belt 11 is an endless belt that circulates in a state of being suspended by the drive roller 21, the tension roller 22, and the idler rollers 25 and 26. The drive roller 21, the tension roller 22, and the idler rollers 25 and 26 are rollers configured to rotate around axial lines thereof. In some examples, the tension roller 22, and the idler rollers 25 and 26 comprise driven rollers which are driven by rotational drive of the drive roller 21. The primary transfer roller 27 may be configured to press the image carrier 140 on an inner peripheral side of the transfer belt 11. The secondary transfer roller 133 is disposed in parallel to the tension roller 22 with the transfer belt 11 interposed therebetween, and presses the tension roller 22 from an outer peripheral side of the transfer belt 11. The secondary transfer roller 133 forms the transfer nip portion R2 between the secondary transfer roller 133 and the transfer belt 11.

The image carrier 140 may comprise an electrostatic latent image holding body in which an image is formed on a peripheral surface thereof, and may also be referred to as a photoconductive drum. In some examples, the image carrier 140 comprises an organic photoconductor (OPC). The imaging apparatus 1 may be configured to form a color image. In some examples, the imaging apparatus 1 comprises four image carriers 140 corresponding with four colors. The image carriers 140 are provided along a movement direction of the transfer belt 11. In some examples, each of the image carriers 140 is formed in a cylindrical shape. The developing device 120, a charging roller 141, an exposure unit 142, and a cleaning unit 143 are provided at the periphery of the image carrier 140.

The charging roller 141 may comprise a charging unit that uniformly charges a surface of the image carrier 140 to a predetermined potential. The charging roller 141 moves in conformity to rotation of the image carrier 140. The exposure unit 142 exposes a surface of the image carrier 140 charged by the charging roller 141, corresponding with an image that is formed on the sheet P. Accordingly, a potential of a portion exposed by the exposure unit 142 varies in the surface of the image carrier 140, and the electrostatic latent image is formed. Each of the four developing devices 120 develops the electrostatic latent image formed on the image carrier 140 by a toner supplied from a toner tank N that is provided to face the developing device 120, and generates a toner image. In some examples, each toner tank N may be filled with one of the toners of magenta, yellow, cyan, and black. The cleaning unit 143 recovers the toner that remains on the image carrier 140 after the toner image formed on the image carrier 140 is initially transferred to the transfer belt 11.

The fixing device 150 may be configured so that the sheet P passes through a fixing nip portion, in which heating and pressing are performed, in order to fix the toner image that is secondarily transferred from the transfer belt 11 to the sheet P. The fixing device 150 includes a heating roller 152 that heats the sheet P, and a pressing roller 154 that presses the heating roller 152 to rotate. The heating roller 152 and the pressing roller 154 are formed in a cylindrical shape, and the heating roller 152 includes a heat source such as a halogen lamp on an inner side thereof. The fixing nip portion as a contact region is formed between the heating roller 152 and the pressing roller 154, and when the sheet P passes through the fixing nip portion, the toner image is fused or otherwise fixed to the sheet P.

The ejection device 160 includes ejection roller 162 and 164 which eject the sheet P on which the toner image is fixed to the outside of the apparatus.

The imaging apparatus 1 may be provided with a cleaning device 170. The cleaning device 170 may include a housing 171 that is opened toward the transfer belt 11, a cleaning member 172 that is provided inside the housing 171, and a conveying screw 173. In some examples, the cleaning member 172 may be a cleaning blade or a cleaning brush. The cleaning member 172 may be configured to come into contact with the surface of the transfer belt 11. In some examples, the transfer belt 11 is pressed or engaged between the cleaning member 172 and the tension roller 22. The cleaning member 172 recovers toner that remains on a surface of the transfer belt 11. The conveying screw 173 conveys the toner recovered into the housing 171 by the cleaning member 172 to one end at the inside of the housing 171. The toner conveyed to the one end may be recovered to the outside of the housing 171.

A printing process that may be performed by the imaging apparatus 1 will be described with reference to FIG. 1. When an image signal of an image to be recorded is input to the imaging apparatus 1, the paper feeding roller 111 rotates, and the sheet P stacked in the cassette K is conveyed. In addition, the surface of the image carrier 140 is uniformly charged to a predetermined potential by the charging roller 141 (charging process). Then, the surface of the image carrier 140 is irradiated with laser light by the exposure unit 142 on the basis of the image signal that is received, and thus an electrostatic latent image is formed (exposure process).

When the developing device 120 develops the electrostatic latent image of the image carrier 140, a toner image is formed on the image carrier 140 (development process). The toner image is initially transferred to the transfer belt 11 form the image carrier 140 in a region in which the image carrier 140 and the transfer belt 11 face each other (transfer process). Toner images formed on the four image carriers 140 may be sequentially superimposed on the transfer belt 11, and one composite toner image is formed. In addition, the composite toner image is secondarily transferred to the sheet P that is transferred from the conveying device 110 in the transfer nip portion R2 in which the drive roller 21 and the secondary transfer roller 133 face each other.

The sheet P to which the composite toner image is secondarily transferred is conveyed to the fixing device 150. In addition, when the sheet P passes through the fixing nip portion in the fixing device 150, the sheet P is heated and pressed between the heating roller 152 and the pressing roller 154. Accordingly, the composite toner image is fused or otherwise fixed to the sheet P (fixing process). Then, the sheet P is ejected to the outside of the imaging apparatus 1 by the ejection rollers 162 and 164.

The belt drive device 100 will be further described with reference to FIG. 2 and FIG. 3.

Figure 2:
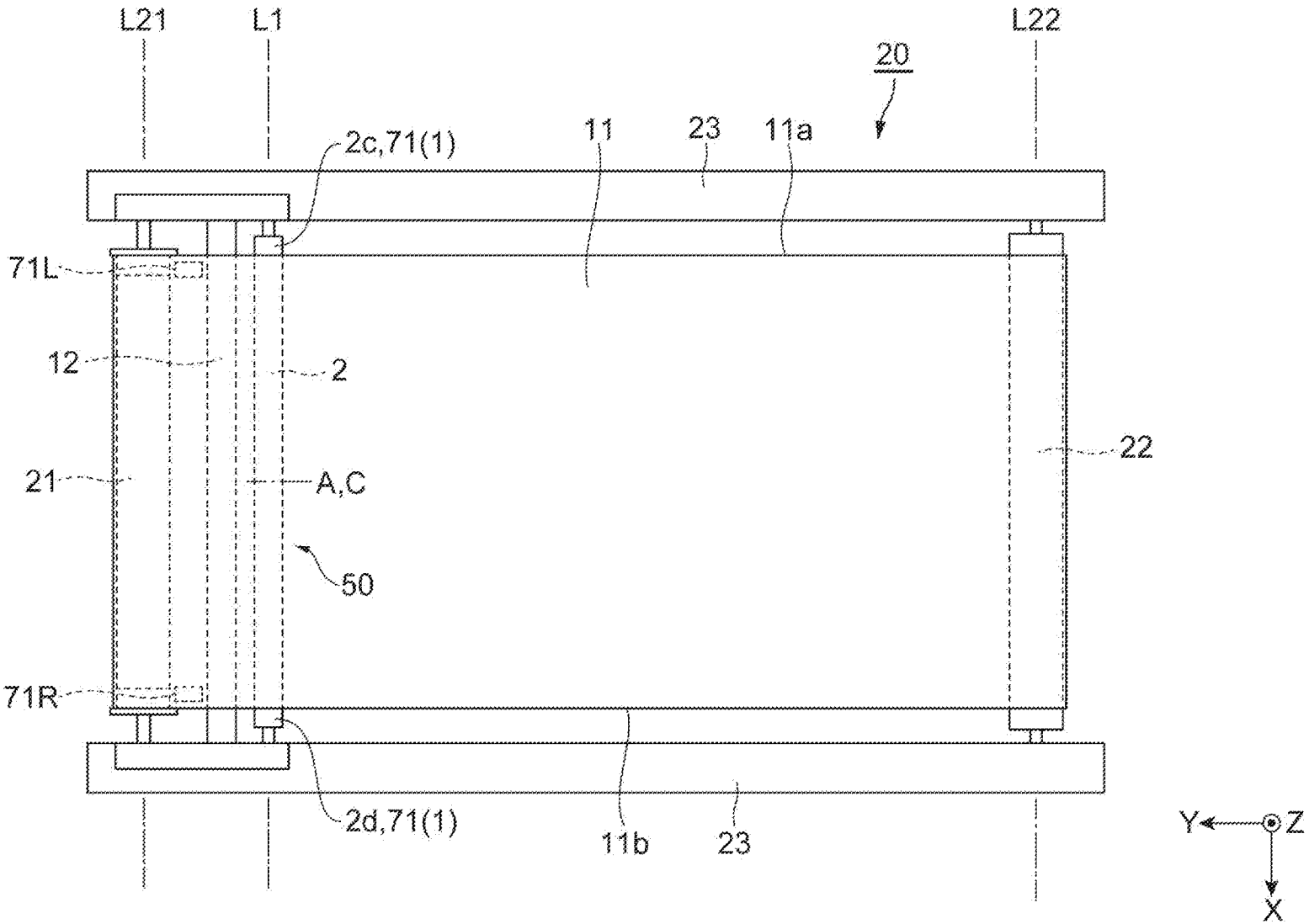
FIG. 2 is a schematic plan view illustrating an example belt drive device.

FIG. 2 is a schematic plan view illustrating an example belt drive device. FIG. 3 is a schematic side view illustrating the example belt drive device. In FIG. 2 and FIG. 3, certain structures are omitted for visibility of the features illustrated in the drawings. As illustrated in FIG. 2 and FIG. 3, the belt drive device 100 includes a transfer belt 11, the drive roller 21, the tension roller 22, the idler rollers 25 and 26, the primary transfer roller 27, and a steering mechanism 50. The transfer belt 11 may comprise an endless belt, and includes a first end edge 11*a* and a second end edge 11*b* that is opposite to the first end edge 11*a*. The first end edge 11*a* and the second end edge 11*b* extend in the Y-direction. The transfer belt 11 is suspended by the drive roller 21, the tension roller 22, and the idler rollers 25 and 26.

The drive roller 21 extends in the X-direction. The drive roller 21 may be configured to rotate around an axial line L21 that extends in the X-direction. In some examples, the drive roller 21 has a cylindrical shape. The drive roller 21 rotates by using power transmitted from an electric motor.

The tension roller 22 extends in the X-direction. The tension roller 22 is spaced away from the drive roller 21 in the Y-direction. The tension roller 22 may be configured to rotate around an axial line L22 that extends in the X-direction. In some examples, the tension roller 22 has a cylindrical shape. The tension roller 22 is driven to rotate in accordance with movement of the transfer belt 11. The tension roller 22 may be biased in a direction so that the tension roller 22 is spaced away from the drive roller 21 by an elastic member such as a coil spring that is disposed along a front and rear direction. In some examples, a tensioning system that applies a tension to the transfer belt 11 is formed by respective rollers including the drive roller 21 and the tension roller 22.

Figure 3:
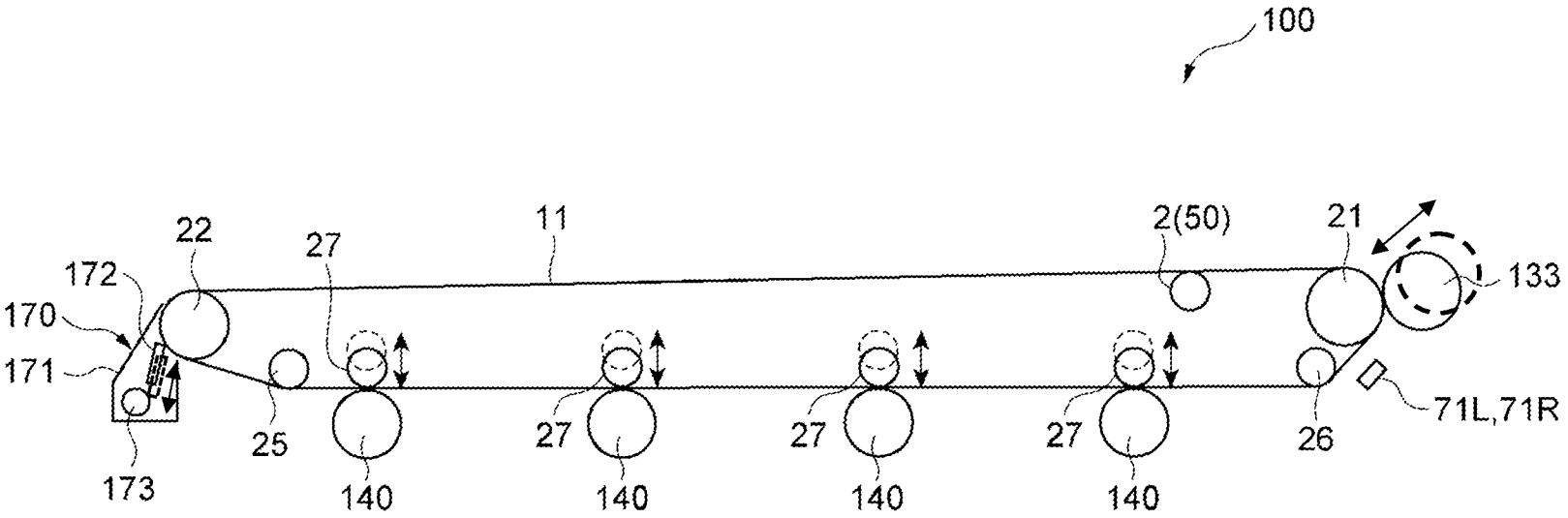
FIG. 3 is a schematic side view illustrating an example belt drive device.

As illustrated in FIG. 3, the idler rollers 25 and 26 extend in the X-direction. The idler roller 25 is located adjacent to the tension roller 22, and the idler roller 26 is located adjacent to the drive roller 21. The idler rollers 25 and 26 are located on a lower side of the drive roller 21 and the tension roller 22.

The four primary transfer rollers 27 (an example of a contact member) may be arranged to be spaced apart from each other in the Y-direction between the idler roller 25 and 26. Each of the primary transfer rollers 27 extends in the X-direction. The primary transfer roller 27 can be switched between an engagement state and a separation state. In the engagement state, the primary transfer roller 27 is in contact with the transfer belt 11 from an inner side. In the engagement state, the transfer belt 11 is pressed or engaged between the primary transfer roller 27 and the image carrier 140. In the separation state, the primary transfer roller 27 is spaced apart or moved away from the transfer belt 11. In the separation state, the transfer belt 11 is not pressed by the primary transfer roller 27, and thus the transfer belt 11 can be spaced apart or move away from the image carrier 140. In some examples, the primary transfer roller 27 moves vertically to switch between the engagement state and the separation state.

The example imaging apparatus 1 may comprise a detector that detects slack at a part of the transfer belt 11. In some examples, the detector includes a pair of optical sensors 71L and 71R which detect a state of the first end edge 11*a* and the second end edge 11*b* of the transfer belt 11 in a non-contact manner. For example, the optical sensors 71L and 71R include a light-emitting element and a light-receiving element, and the light-receiving element receives light that is emitted from the light-emitting element and reflected from the transfer belt 11. In some examples, a correction pattern is transferred to the transfer belt 11 by the four image carriers 140 corresponding to the respective colors of magenta, yellow, cyan, and black. The pair of optical sensors 71L and 71R may be configured to detect the correction pattern transferred to the transfer belt 11 at a position downstream of the primary transfer roller 27. The correction pattern may be transferred to both ends of the transfer belt 11 in the right and left direction. In some examples, the correction pattern is transferred to both ends of the transfer belt 11 in the right and left direction at the same time by the image carrier 140. Accordingly, the pair of optical sensors 71L and 71R are disposed at positions which respectively face both ends of the transfer belt 11 in the right and left direction. The correction pattern may be a predetermined toner image that is formed on the transfer belt 11 for color registration control. Additionally, the pair of optical sensors 71L and 71R may be sensors for the color registration control. In some examples, the color registration control may be executed on the basis of the correction pattern that is read by the pair of optical sensors 71L and 71R in the imaging apparatus 1. Furthermore, the correction pattern may be a toner image that may be selectively or in some cases exclusively used in detection of the slack of the transfer belt 11.

As illustrated in FIG. 2, the belt drive device 100 includes a pair of frames 23. The frames 23 extend in the Y-direction. The pair of frames 23 are disposed to be spaced away from each other in the X-direction. The pair of frames 23 rotatably supports the drive roller 21 and the tension roller 22. In addition, the primary transfer roller 27 and the idler rollers 25 and 26 may be supported by the pair of frames 23.

Figure 4:
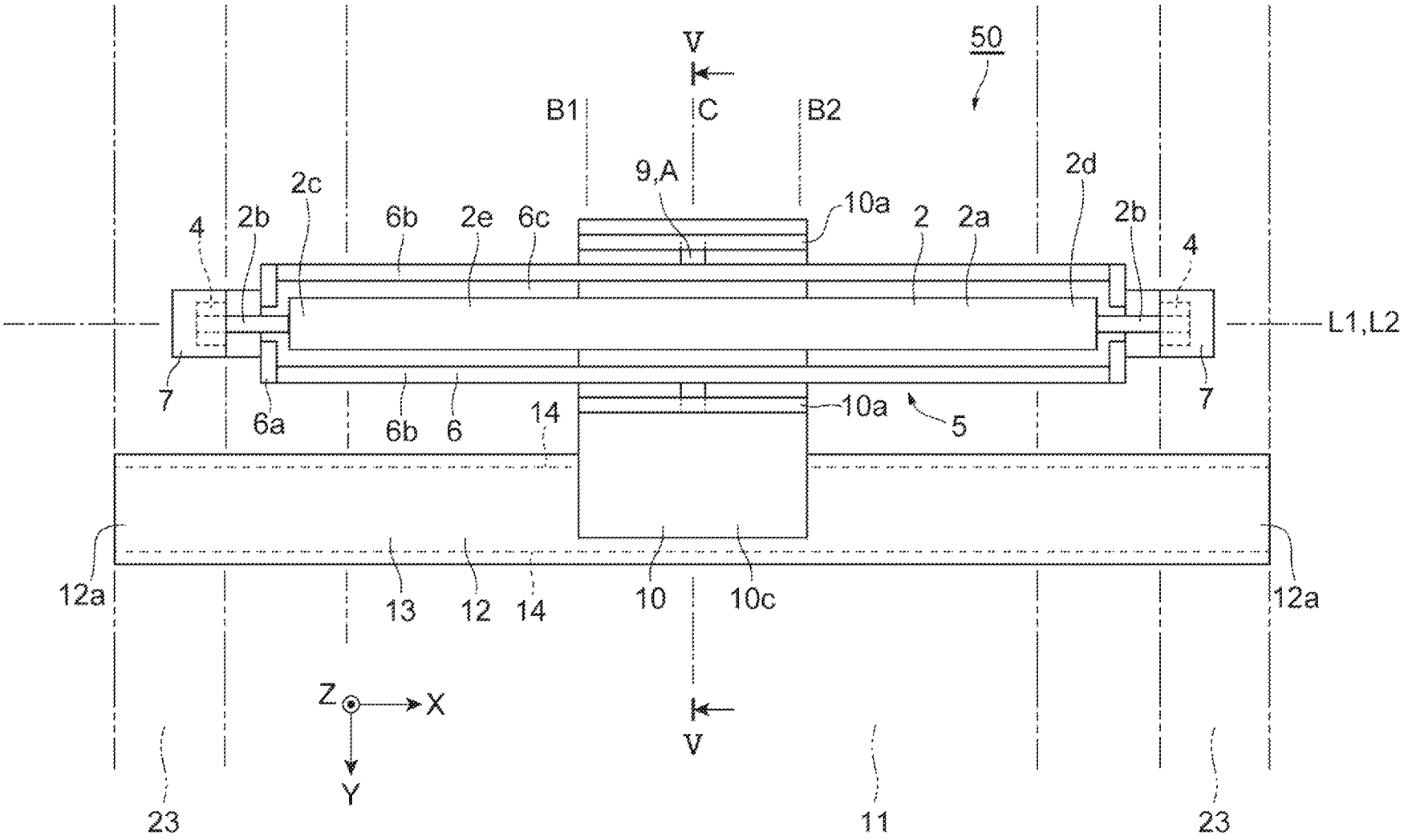
FIG. 4 is a plan view illustrating an example steering mechanism.
Figure 5:
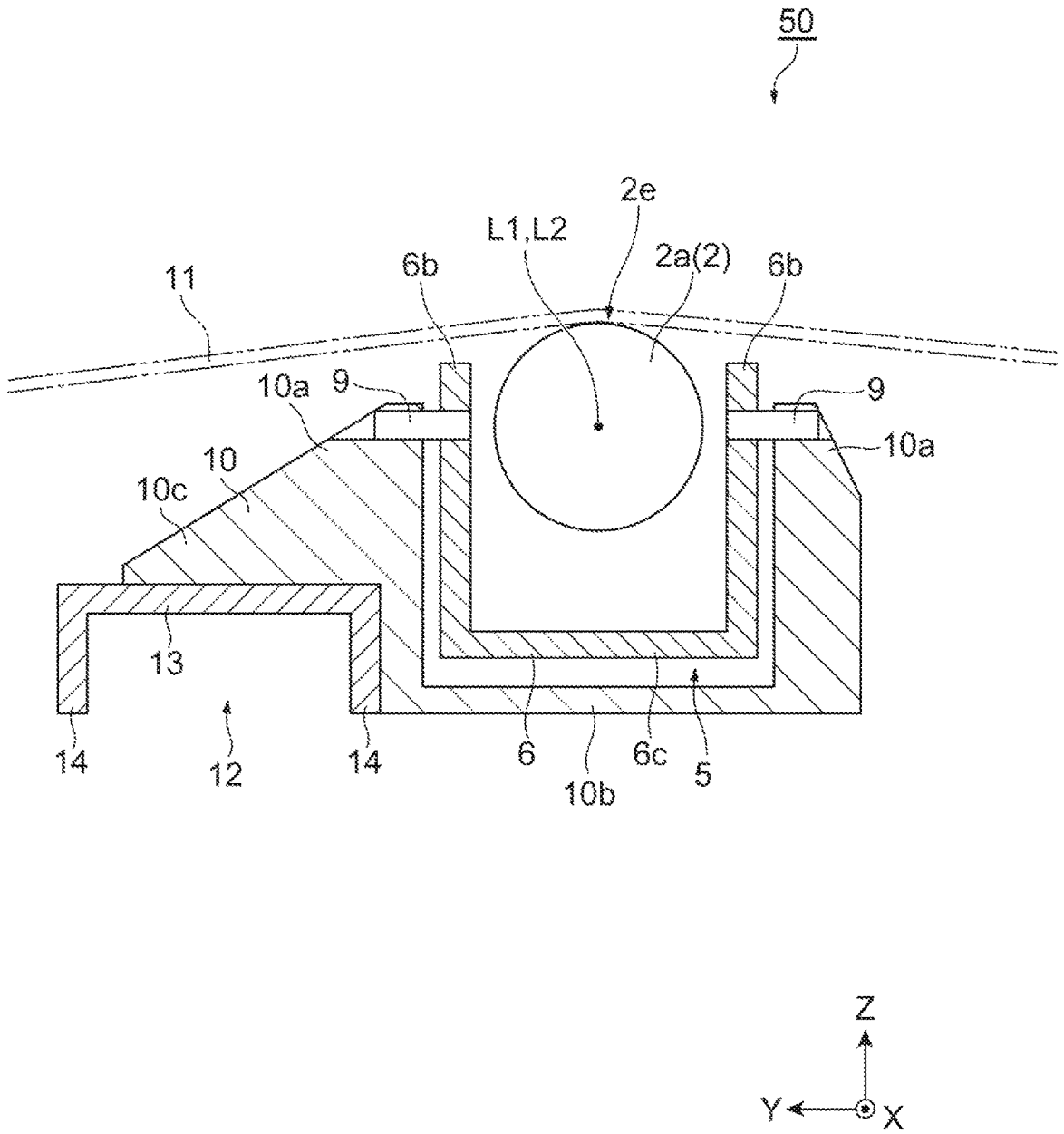
FIG. 5 is a cross-sectional view taken along line V-V in FIG. 4.
Figure 6:
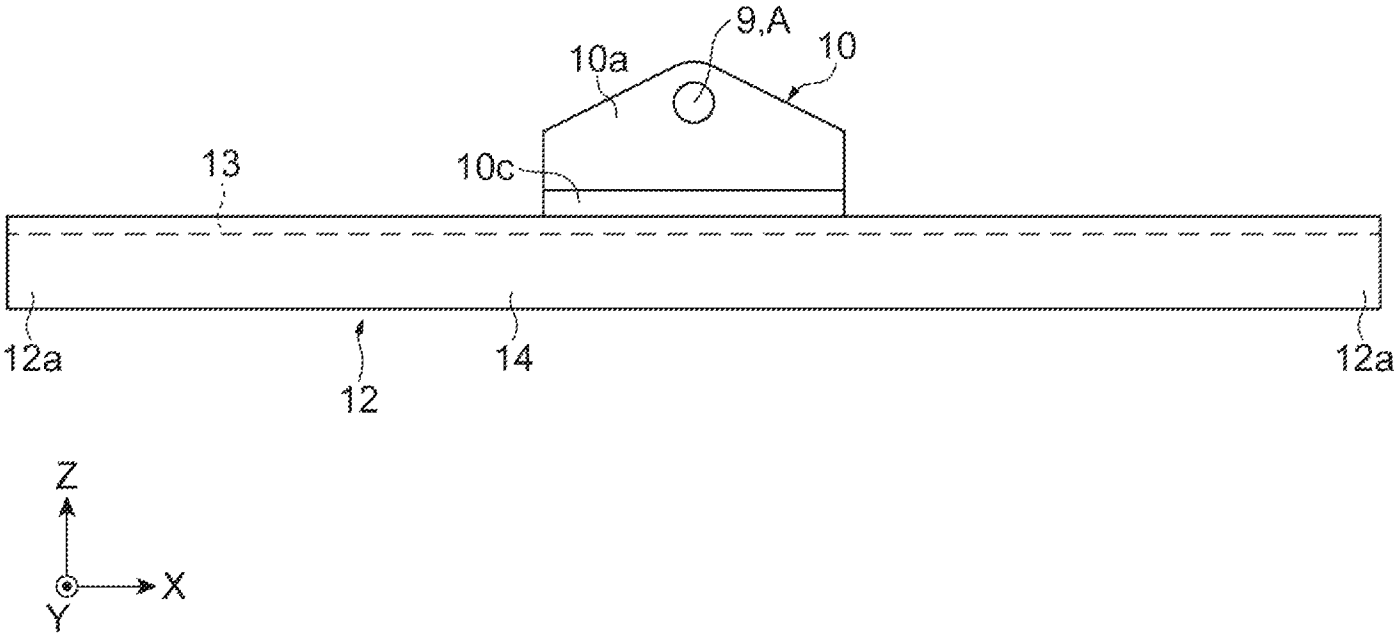
FIG. 6 is a front view illustrating an example pivot shaft holding member and a connection member.
Figure 7:
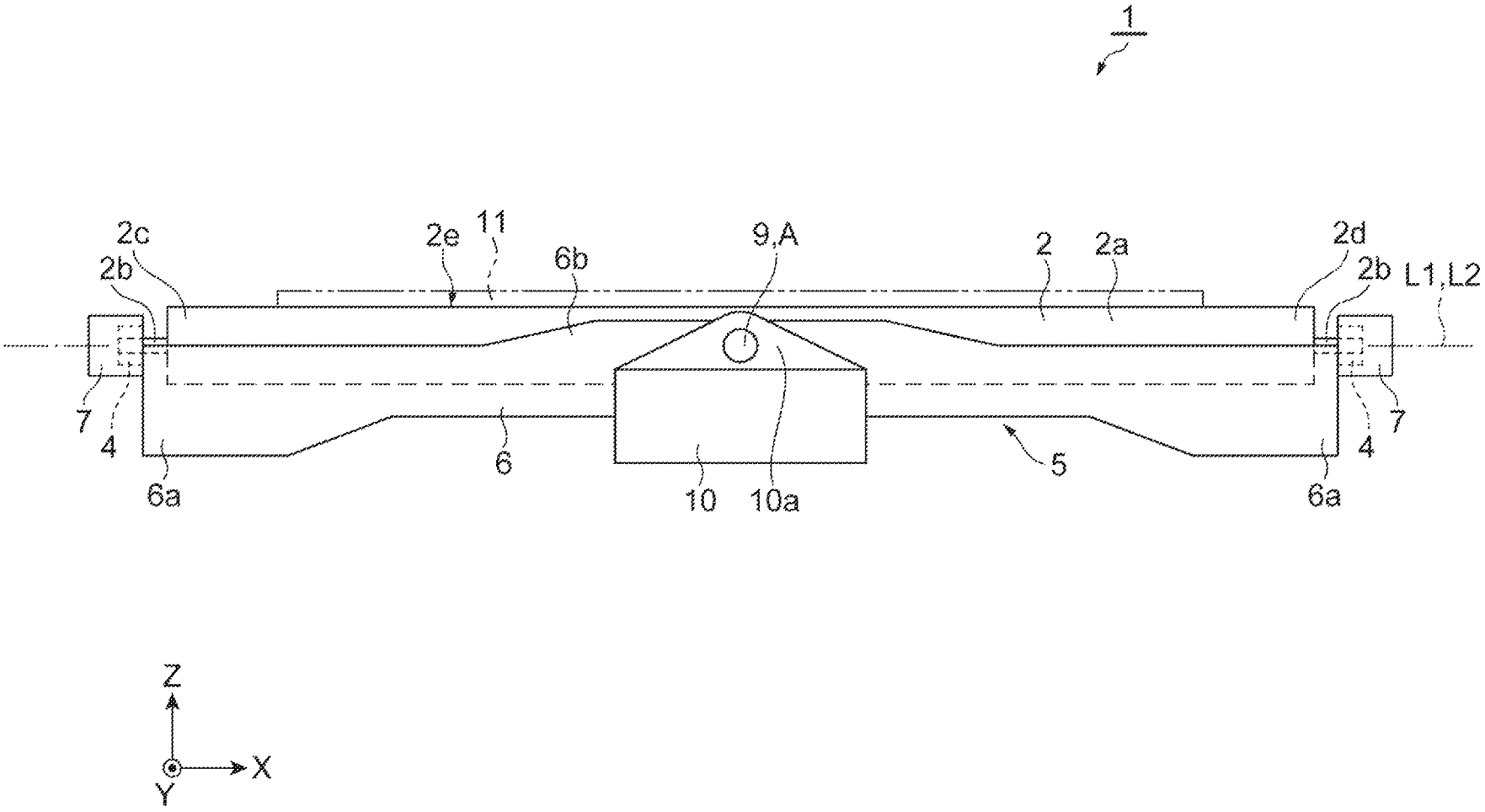
FIG. 7 is a front view illustrating an example steering mechanism.

FIG. 4 is a plan view illustrating an example steering mechanism 50. FIG. 5 is a cross-sectional view illustrating the example steering mechanism 50. FIG. 5 is a cross-sectional view taken along line V-V in FIG. 4. FIG. 6 is a side view illustrating an example pivot shaft holding member 10 and a connection member 12. FIG. 7 is a front view illustrating the example steering mechanism 50 with the connection member 12 omitted. The steering mechanism 50 includes a steering roller 2, a steering roller holding member 5, the pivot shaft holding member 10, and the connection member 12. The steering mechanism 50 may be configured to change a position of the transfer belt 11 in the X-direction by applying an increased tension along a first end edge of an endless belt.

The steering roller 2 is disposed between the drive roller 21 and the tension roller 22 in the Y-direction. For example, the steering roller 2 is disposed at a position that is closer to the drive roller 21 in comparison to the center in the Y-direction. In some examples, the steering roller 2 may be disposed at a position that is closer to the tension roller 22 in comparison to the center in the Y-direction. An axial line L1 of the steering roller 2 is disposed at a position that is higher than the axial line L21 of the drive roller 21 in the Z-direction. The steering roller 2 may be disposed to come into contact with the transfer belt 11 that is disposed on a lower side.

The steering roller 2 includes a roller main body 2*a* and a pair of small-diameter portions 2*b*. In a longitudinal direction L2 of the steering roller 2, the small-diameter portions 2*b* extend from the roller main body 2*a* to the outer side. In some examples, the roller main body 2*a* and the small-diameter portions 2*b* have a cylindrical shape. An outer diameter of the small-diameter portions 2*b* is smaller than an outer diameter of the roller main body 2*a*. The roller main body 2*a* and the small-diameter portions 2*b* are concentric to each other.

The steering roller 2 is supported to rotate around the axial line L1 by a pair of bearings 4. The axial line L1 is a virtual straight line that extends along the longitudinal direction L2 of the steering roller 2. The bearings 4 rotatably support both ends of the steering roller 2 in the longitudinal direction L2. In some examples, the bearings 4 may comprise a cylindrical sleeve or other types of bearings. Each of the bearings 4 includes a surface that may be configured to come into contact with an outer peripheral surface of each of the small-diameter portions 2*b*.

The steering roller holding member 5 holds the steering roller 2. The steering roller holding member 5 includes a steering roller holding member main body 6 and a pair of bearing holding members 7. The steering roller holding member main body 6 extends along the longitudinal direction L2 of the steering roller 2. In some examples, the bearing holding members 7 include a cylindrical bearing accommodation portion. Each of the bearings 4 of the steering roller 2 is held by each of the bearing holding members 7. The pair of bearing holding members 7 are respectively attached to both ends 6*a* of the steering roller holding member main body 6 in the longitudinal direction L2 of the steering roller 2.

The steering roller holding member main body 6 may include a pair of side plates 6*b* which face each other in the Y-direction. For example, a plate thickness direction of the side plates 6*b* is a direction along the Y-direction, and the steering roller holding member main body 6 may include a bottom plate 6*c*. The bottom plate 6*c* extends in the longitudinal direction L2 of the steering roller 2 and connects the pair of side plates 6*b* to each other. A plate thickness direction of the bottom plate 6*c* conforms to the Z-direction. The steering roller 2 is disposed in a space at least partially surrounded by the pair of side plates 6*b* and the bottom plate 6*c*. In a peripheral direction of the steering roller 2, a part of the outer peripheral surface 2*e* is exposed to the outside of the steering mechanism 50. In the outer peripheral surface 2*e*, a portion on an upper side in comparison to the side plates 6*b* is exposed to the outside, and may be configured to engage or otherwise contact the transfer belt 11. A pivot shaft 9 is provided in the side plates 6*b*. For example, the pivot shaft 9 has a cylindrical shape, and serves as a fulcrum A. The pivot shaft 9 extends in the Y-direction.

The pivot shaft holding member 10 rotatably supports the pivot shaft 9. The pivot shaft holding member 10 may include a pair of side portions 10*a* which are disposed on opposite sides of the steering roller 2 from each other in the Y-direction. In the Y-direction, the pair of side portions 10*a* is disposed on the outer side of the steering roller holding member main body 6. In some examples, the steering roller holding member main body 6 is disposed between the pair of side portions 10*a*. The side portions 10*a* are disposed to face the side plates 6*b* in the Y-direction. A bearing portion that rotatably supports the pivot shaft 9 is formed in the side portions 10*a*. For example, the bearing portion may comprise a through-hole. The steering roller 2 may be configured to pivot, rotate or swing in a state in which the pivot shaft 9 is set as the fulcrum A.

The example pivot shaft holding member 10 includes a bottom portion 10*b*. The bottom portion 10*b* may be divided in the Y-direction. The bottom portion 10*b* protrudes from a lower side of the side portions 10*a* in the Y-direction. The bottom portion 10*b* is disposed to face the bottom plate 6*c* in the Z-direction. The bottom plate 6*c* is located between the bottom portion 10*b* and the steering roller 2.

The pivot shaft holding member 10 may include a protruding portion 10*c* that protrudes from one of the side portions 10*a*. For example, the protruding portion 10*c* protrudes to a drive roller 21 side in the Y-direction.

The connection member 12 extends in the X-direction, and connects the pivot shaft holding member 10 and the frames 23. The connection member 12 is disposed, for example, between the drive roller 21 and the steering roller 2 in the Y-direction. The connection member 12 may include a plate portion 13, and a pair of side plates 14. A plate thickness direction of the plate portion 13 conforms to the Z-direction. The pair of side plates 14 are disposed to be separated from each other in the Y-direction. A plate thickness direction of the side plates 14 conforms to the Y-direction. The pair of side plates 14 protrudes downward from the plate portion 13. The protruding portion 10*c* of the pivot shaft holding member 10 is attached to an upper surface of the plate portion 13. A lower end of the side portion 10*a* of the pivot shaft holding member 10 may be in contact with the side plates 14 in the Y-direction. The pivot shaft holding member 10 is fixed to the connection member 12, and can move integrally with the connection member 12. Ends 12*a* of the connection member 12 in a longitudinal direction are supported, for example, by the frames 23.

An example end structure of the drive roller 21 is described with reference to FIG. 8. The drive roller 21 may include a first belt roller main body 21*a* and a small-diameter portion 21*b*. The small-diameter portion 21*b* protrudes from an end of the first belt roller main body 21*a* to the outer side in the X-direction. A length of the transfer belt 11 in the X-direction is longer than a length of the first belt roller main body 21*a* in the X-direction. The transfer belt 11 extends beyond the first belt roller main body 21*a* in the X-direction. The belt drive device 100 may include a bearing 51 that rotatably supports the drive roller 21. In some examples, the bearing 51 may comprise a cylindrical sleeve, or other structures.

The steering mechanism 50 may include a pulley 52 and a link mechanism 53. In some examples, the pulley 52 is attached to the drive roller 21. The pulley 52 may be configured to move in the X-direction in response to movement of the transfer belt 11 in the X-direction.

A central opening 52*a* is formed in the pulley 52. The small-diameter portion 21*b* may be configured to be inserted into the central opening 52*a*. The pulley 52 includes a main body portion 52*b*, a flange portion 52*c*, and a small-diameter portion 52*d*. In some examples, the main body portion 52*b* has a cylindrical shape. The central opening 52*a* is formed at the center of the main body portion 52*b*. An outer diameter of the main body portion 52*b* is approximately the same as an outer diameter of the first belt roller main body 21*a*. An outer peripheral surface of the main body portion 52*b* may be configured to come into contact with the transfer belt 11.

The flange portion 52*c* further protrudes outward in comparison to the outer peripheral surface of the main body portion 52*b* in a diameter direction (e.g., the z-direction). In some examples, the flange portion 52*c* has a larger diameter than the main body portion 52*b*. The flange portion 52*c* is formed over an entire periphery of the pulley 52 in a peripheral direction. The flange portion 52*c* may be located on opposite ends of the first belt roller main body 21*a* in the X-direction. The flange portion 52*c* may extend to an outer surface of the transfer belt 11 in a diameter direction (e.g., the z-direction). The outer surface of the transfer belt 11 is a surface that faces away from the drive roller 21. An inner surface of the transfer belt 11 faces toward the drive roller 21, and may be configured to come into direct contact with the drive roller 21. An end surface of the transfer belt 11 connects the outer surface with the inner surface of the transfer belt 11 and is located on an end of the transfer belt 11 in the X-direction.

The flange portion 52*c* includes a surface that may be configured to come into contact with the end surface of the transfer belt 11 in the X-direction. For example, when the position of the transfer belt 11 deviates in the X-direction toward the outer side, the end surface of the transfer belt 11 comes into contact with the flange portion 52*c*. The pulley 52 receives the positional deviation of the transfer belt 11 and slides or otherwise moves in the X-direction.

The small-diameter portion 52*d* of the pulley 52 protrudes outward further in the X-direction as compared to the flange portion 52*c*. The small-diameter portion 52*d* includes a cylindrical portion having a diameter smaller than that of the main body portion 52*b*. The central opening 52*a* is formed at the center of the small-diameter portion 52*d*.

The link mechanism 53 may include a first intermediate member 54, a pin 55, and a second intermediate member 56. The first intermediate member 54 is mounted on the drive roller 21. The first intermediate member 54 is disposed between the pulley 52 and the bearing 51 in the X-direction. When the pulley 52 moves outward in the X-direction, the first intermediate member 54 is pressed by the pulley 52 and moves outward in the X-direction. An opening 54*a* is provided in the first intermediate member 54. The small-diameter portion 21*b* of the drive roller 21 is inserted into the opening 54*a* in the X-direction.

The first intermediate member 54 includes a main body portion 54*b* in which the opening 54*a* is formed. An inclined surface 54*c* is formed on an outer surface of the main body portion 54*b*. For example, the inclined surface 54*c* is a surface on an upper side of the main body portion 54*b*. The inclined surface 54*c* is inclined so as to be spaced further away from the axial line L21 in relationship to the distance from the end of the small-diameter portion 21*b* of the drive roller 21 in the X-direction. In some examples, the inner portion of the inclined surface 54*c* is inclined so as to be elevated or higher in the Z-direction as compared to the outer portion of the inclined surface. Accordingly, when the first intermediate member 54 moves outward in the X-direction, the inclined surface 54*c* is configured to exert an at least partially upward force on a member (e.g., the pin 55) which is in contact with the inclined surface 54C.

Figure 9:
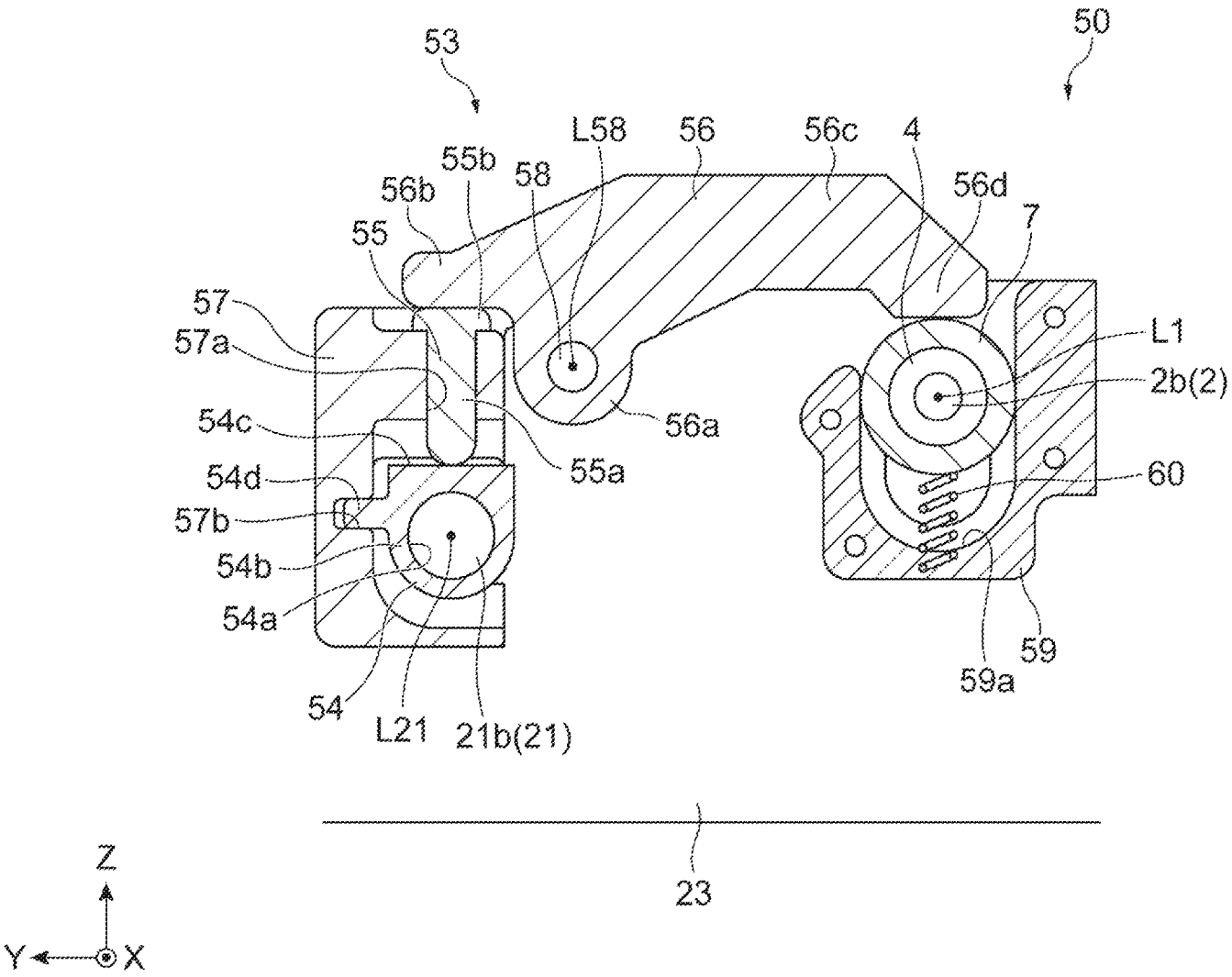
FIG. 9 is a cross-sectional view taken along line IX-IX in FIG. 8.

As illustrated in FIG. 9, a protruding piece 54*d* that protrudes outward is formed in a side portion of the main body portion 54*b*. For example, the protruding piece 54*d* comprises a plate shape and is contiguous in the X-direction. The protruding piece 54*d* is contiguous in a direction in which the opening 54*a* passes. A plate thickness direction of the protruding piece 54*d* conforms to the Z-direction.

The pin 55 may include a main body portion 55*a* and a flange portion 55*b*. The main body portion 55*a* may comprise a cylindrical shape. The flange portion 55*b* protrudes outward from the main body portion 55*a* in a diameter direction. The main body portion 55*a* is disposed in the Z-direction. The flange portion 55*b* is formed on an upper end of the main body portion 55*a*. In some examples, a lower end of the main body portion 55*a* includes a spherical surface.

The link mechanism 53 may include a holding member 57. The holding member 57 is attached to the frame 23. The holding member 57 includes a pin holding portion 57*a* and a first intermediate member guide portion 57*b*. An opening is formed in pin holding portion 57*a*. The pin 55 is inserted into the opening in the Z-direction. A surface that may be configured to come into contact with the flange portion 55*b* of the pin 55 is formed at an edge portion of the opening. When the flange portion 55*b* comes into contact with the edge portion of the opening, a position of the pin 55 in the Z-direction is restricted. When the flange portion 55*b* comes into contact with the edge portion of the opening, downward movement of the pin 55 is restricted.

The first intermediate member guide portion 57*b* includes a guide groove that guides movement of the protruding piece 54*d* of the first intermediate member 54. The first intermediate member guide portion 57*b* is disposed to face the first intermediate member 54 in the Y-direction. A guide groove is provided in a surface of the first intermediate member guide portion 57*b* which faces the first intermediate member 54. The guide groove is contiguous in the X-direction. The protruding piece 54*d* of the first intermediate member 54 is inserted into the guide groove. The protruding piece 54*d* moves along the guide groove, and movement of the first intermediate member 54 in the X-direction is guided.

The second intermediate member 56 may include a fulcrum portion 56*a*, a flat plate portion 56*b*, a contiguous portion 56*c*, and a pressing portion 56*d*. The second intermediate member 56 may be configured to pivot, rotate or swing around the fulcrum portion 56*a* that is a pivot portion. An opening is formed in the fulcrum portion 56*a*. A support shaft is inserted into the opening. The support shaft 58 is inserted into the opening. In some examples, the support shaft 58 is attached to the frame 23. The support shaft 58 extends in the X-direction. The support shaft 58 extends inward from the frame 23 in the X-direction. The support shaft 58 is disposed between the drive roller 21 and the steering roller 2 in the Y-direction. The fulcrum portion 56*a* may be configured to rotate around the support shaft 58. For example, an axial line L58 of the support shaft 58 is disposed on an upper side in comparison to the axial lines L21 and 11 in the Z-direction.

The flat plate portion 56*b* is connected to the fulcrum portion 56*a*, and protrudes outward in the Y-direction. The flat plate portion 56*b* extends to the drive roller 21 side in the Y-direction. The flat plate portion 56*b* is disposed on an upward facing side of the second intermediate member 56 in comparison to the fulcrum portion 56*a*. The flat plate portion 56*b* extends to a position configured to come into contact with an upper end of the pin 55. The flat plate portion 56*b* can come into contact with the upper end of the pin 55. The flat plate portion 56*b* is displaced in accordance with movement of the pin 55 in the Z-direction. When the pin 55 moves upward, the flat plate portion 56*b* moves upward in conjunction with the flat plate portion 56*b*.

The contiguous portion 56*c* is connected to the fulcrum portion 56*a*, and extends inward in the X-direction. The contiguous portion 56*c* extends to a side opposite to the flat plate portion 56*b* in the Y-direction. The contiguous portion 56*c* is disposed on an upward facing side of the second intermediate member 56 in comparison to the fulcrum portion 56*a*. The contiguous portion 56*c* extends over the bearing holding member 7. The contiguous portion 56*c* pivots, rotates or swings in accordance with rotation of the fulcrum portion 56*a*. The pressing portion 56*d* is provided at a tip end of the contiguous portion 56*c*. The pressing portion 56*d* includes a surface that comes into contact with an outer surface of the bearing holding member 7. When the contiguous portion 56*c* swings, the pressing portion 56*d* moves downward to press the bearing holding member 7, and to press down the bearing 4 and a first end 2*c* of the steering roller 2.

The link mechanism 53 may include a connection tool 59. In some examples, the connection tool 59 is connected to the frame 23. The connection tool 59 may include an accommodation portion 59*a* that accommodates the bearing holding member 7. The connection tool 59 may include a surface that guides movement of the bearing holding member 7 in the Z-direction. The connection tool 59 can hold the spring member 60. The spring member 60 is disposed in the Z-direction, and supports the bearing holding member 7 from a downward side. A lower end of the spring member 60 is supported to the connection tool 59. An upper end of the spring member 60 may be configured to come into contact with a lower surface of the bearing holding member 7. The spring member 60 extends and contracts in the Z-direction, and may be configured to bias the bearing holding member 7 to an upward side.

Figure 10B:
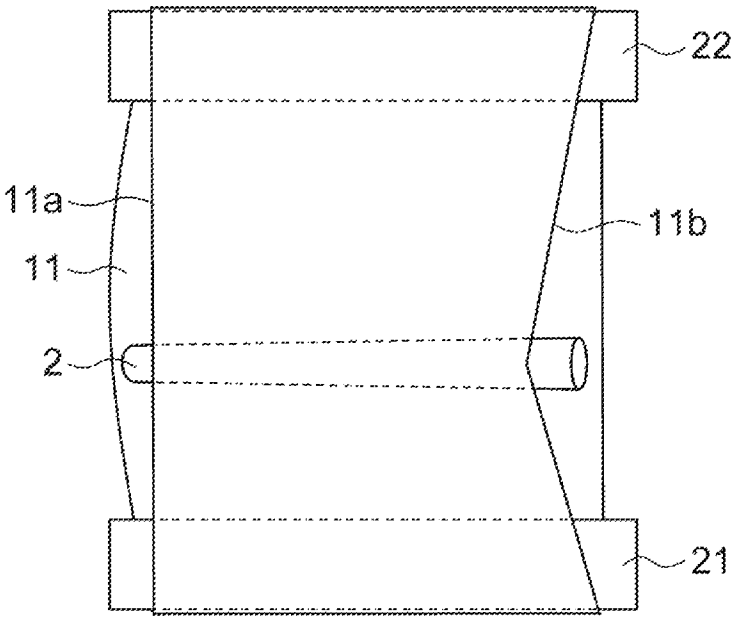
FIG. 10B illustrates a schematic view of another example operation of a belt drive device.
Figure 10A:
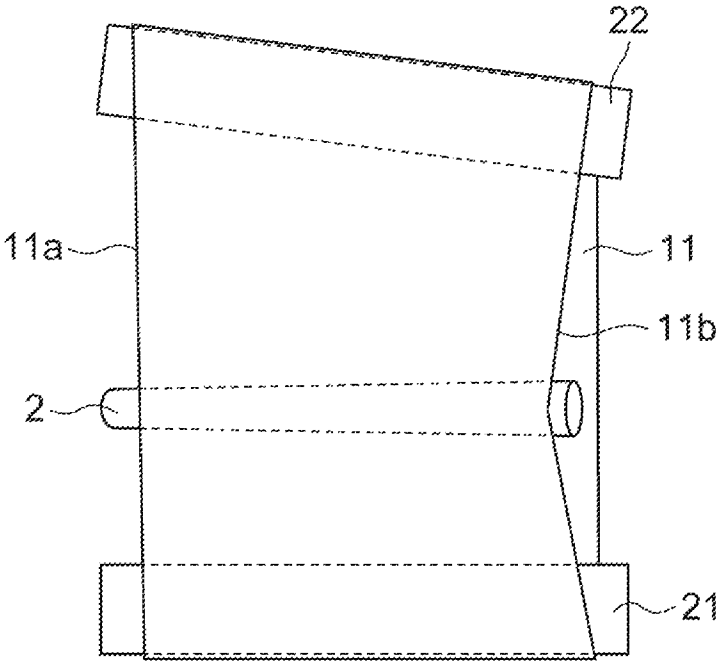
FIG. 10A illustrates a schematic view of an example operation of a belt drive device.

An example operation of the belt drive device 100 will be described with reference to FIGS. 10A and 10B in which the transfer belt 11 deviates to the first end edge 11*a* side. A positional deviation of the transfer belt 11 in the belt drive device 100 is corrected in a width direction. For example, the transfer belt 11 may meander during operation. The transfer belt 11 circulates by using power transmitted from the drive roller 21. The tension roller 22 rotates in accordance with movement of the transfer belt 11. The steering roller 2 rotates in accordance with movement of the transfer belt 11.

Figure 8:
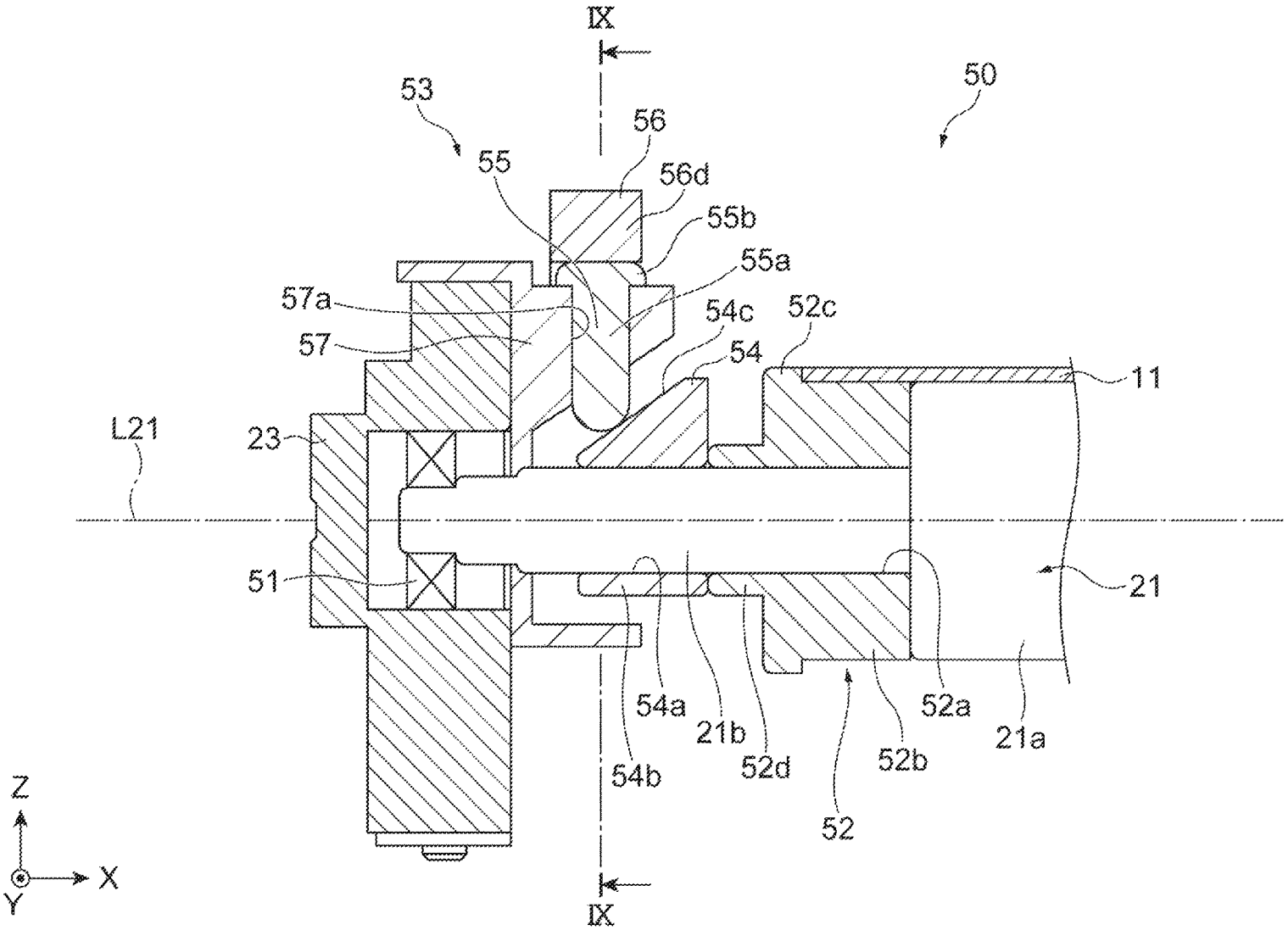
FIG. 8 is a cross-sectional view illustrating an example end structure of a drive roller.

When the transfer belt 11 deviates outward in the width direction, the end surface of the transfer belt 11 comes into contact with the flange portion 52*c* of the pulley 52 (refer to FIG. 8 and FIG. 9). When the amount of movement of the transfer belt 11 in the width direction increases, the transfer belt 11 presses the pulley 52. When the pulley 52 moves outward in the X-direction, the pin 55 is pushed upwards by the sliding contact with the inclined surface 54*c*. When the pin 55 is displaced upward, the flat plate portion 56*b* of the second intermediate member 56 is pushed upward, and thus the second intermediate member 56 swings around the axial line L58.

Accordingly, the pressing portion 56*d* is displaced downward, and pushes up the bearing holding member 7. In addition, as illustrated in FIG. 10A, the steering roller 2 moves downward on the first end edge 11*a* side of the transfer belt 11, and the steering roller 2 is inclined.

When the steering roller 2 is inclined, tension of the transfer belt 11 decreases on the first end edge 11*a* side, and the tension of the transfer belt 11 increases on the second end edge 11*b* side. In some example, the tension on the first end edge 11*a* side becomes lower than the tension of the transfer belt 11 on the second end edge 11*b* side. Accordingly, the transfer belt 11 moves to the second end edge 11*b* side in the width direction. As a result, the positional deviation of the transfer belt 11 is corrected. Furthermore, in a case where the tension of the transfer belt 11 increases on the second end edge 11*b* side, the tension roller 22 that is pressed by the elastic member is pulled to the drive roller 21 side due to the increased tension. Accordingly, inclination occurs in the tension roller 22.

When the transfer belt 11 moves to the second end edge 11*b* side, a force of pushing the pulley 52 outward in the X-direction becomes weak. Accordingly, the spring member 60 presses and pushes up the bearing holding member 7, and thus the pressing portion 56*d* of the second intermediate member 56 moves upward. According to the movement, the flat plate portion 56*b* moves downward, and may be configured to press down the pin 55. When the pin 55 that comes into contact with the inclined surface 54*c* moves downward, the first intermediate member 54 moves inward in the X-direction. The pulley 52 is returned by the first intermediate member 54. In addition, the first end 2*c* of the steering roller 2 returns to the original position.

On the other hand, when the elastic member that presses the tension roller 22 is non-functional, it is considered that inclination does not occur in the tension roller 22 regardless of an increase in the tension of the transfer belt 11 on the second end edge 11*b* side. In this case, due to the increased tension, the tension roller 22 is not inclined, and is pulled to the drive roller 21 side. As a result, as illustrated in FIG. 10B, slack may occur at a part of the transfer belt 11 on the first end edge 11*a* side in which tension decreases. The slack is likely to occur in the transfer belt 11 at a portion that faces the drive roller 21 from the tension roller 22.

In order for the tensioning system (the drive roller 21 and the tension roller 22) to reduce slack of the transfer belt 11, a belt control mechanism 80 controls the primary transfer roller 27 to deviate from the transfer belt 11.

Figure 11:
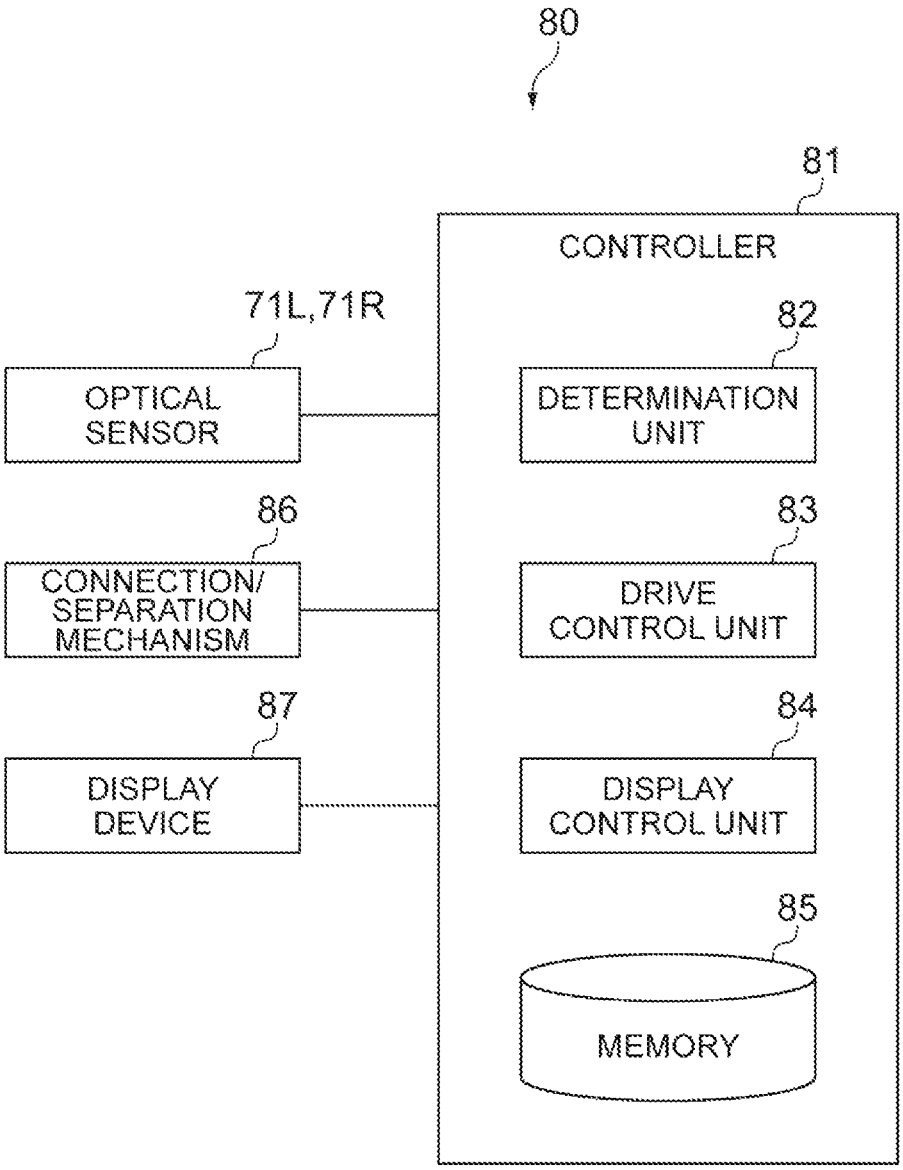
FIG. 11 is a block diagram illustrating an example belt control mechanism.

FIG. 11 is a block diagram illustrating an example belt control mechanism. The belt control mechanism 80 controls an operation of the belt drive device 100 so that the tensioning system reduces slack of the transfer belt 11 when an occurrence of the slack in the transfer belt 11 is detected. Furthermore, the belt control mechanism 80 may control an operation of the belt drive device 100, for example, in a printing process of the imaging apparatus 1.

The belt control mechanism 80 may include a controller 81. An example controller 81 includes a determination unit 82, a drive control unit 83, a display control unit 84, and a memory 85. The controller 81 may comprise a computer including hardware such as a central processing unit (CPU), a read only memory (ROM), and a random access memory (RAM), and machine readable instructions such as a program that is stored in the ROM. The controller 81 is electrically connected or communicatively coupled to the optical sensors 71L and 71R, a connection/separation mechanism 86, and a display device 87.

The connection/separation mechanism 86 controls a position of the primary transfer roller 27. In some examples, the connection/separation mechanism 86 may be configured to switch between an engagement state and a separation state of the primary transfer roller 27. The connection/separation mechanism 86 can switch between the engagement state and the separation state with respect to an arbitrary primary transfer roller 27 among the four primary transfer rollers 27. For example, in an example printing process of the imaging apparatus 1 which includes a black image, the connection/separation mechanism 86 sets the primary transfer roller 27 corresponding to black to the engagement state, and may set the primary transfer rollers 27 corresponding to other colors to the separation state.

The determination unit 82 receives a detection signal transmitted from the optical sensors 71L and 71R. The determination unit 82 may be configured to detect whether or not the transfer belt 11 is loose on the basis of the detection signal. In some examples, the optical sensors 71L and 71R and the determination unit 82 may be configured to detect (e.g., calculate) a speed difference between a rotational speed of the first end edge 11*a* and a rotational speed of the second end edge 11*b* on the basis of a detection of the correction pattern that is transferred to the transfer belt 11. A rotational speed of the transfer belt 11 may be a movement speed of the transfer belt 11 that circulates from the tension roller 22 side to the drive roller 21 side. Hereinafter, a speed difference between the rotational speed of the first end edge 11*a* and the rotational speed of the second end edge 11*b* is referred to as a speed difference for ease of reference. In some examples, the speed difference may relate to slack that occurs in the transfer belt 11.

In the determination unit 82, the speed difference may be derived on the basis of a detection timing of a plurality of the correction patterns which are formed along a rotational direction of the transfer belt 11. For example, the determination unit 82 derives the rotational speed of the transfer belt 11 on the basis of a difference between detection timings of two correction patterns which are detected previously and subsequently in terms of time. In some examples, a rotational speed of the transfer belt 11 at the first end edge 11*a* is derived on the basis of the two correction patterns which are detected by the optical sensor 71L, and a rotational speed of the transfer belt 11 at the second end edge 11*b* is derived on the basis of the two correction patterns which are detected by the optical sensor 71R. In some examples, a movement distance of the transfer belt 11 at the first end edge 11*a* and a movement distance of the transfer belt 11 at the second end edge 11*b* are originally the same as each other. However, where a speed difference occurs between the first end edge 11*a* and the second end edge 11*b*, a difference occurs in the movement distance between the first end edge 11*a* and the second end edge 11*b*. For example, slack occurs in the first end edge 11*a* or the second end edge 11*b*. Accordingly, where the speed difference occurs between the first end edge 11*a* and the second end edge 11*b*, the determination unit 82 may determine that slack occurs. Where the speed difference exceeds a predetermined threshold value, the determination unit 82 may determine that slack occurs in the transfer belt 11.

The drive control unit 83 controls a driving operation of the connection/separation mechanism 86. The drive control unit 83 transmits a signal to the connection/separation mechanism 86 to control movement of the primary transfer roller 27 by the connection/separation mechanism 86. For example, where the determination unit 82 determines that slack occurs in the transfer belt 11, the drive control unit 83 transmits a signal for setting the primary transfer roller 27 to the separation state to the connection/separation mechanism 86. Accordingly, the belt drive device 100 drives the transfer belt 11 in a state in which the primary transfer roller 27 is separated from the transfer belt 11 (in a belt position refresh mode). For example, the drive control unit 83 may transmit a signal for setting all of the primary transfer rollers 27 to the separation state to the connection/separation mechanism 86. In addition, where the determination unit 82 determines that the speed difference exceeds the predetermined threshold value, the drive control unit 83 may transmit a signal for setting the primary transfer roller 27 to the engagement state to the connection/separation mechanism 86. Still further, where the transfer belt 11 circulates for a constant time in a state in which the primary transfer roller 27 is separated, the drive control unit 83 may transmit a signal for setting the primary transfer roller 27 to the engagement state to the connection/separation mechanism 86.

The display control unit 84 may be configured to generate image information that is displayed on the display device 87. For example, in a case where the determination unit 82 determines that slack occurs in the transfer belt 11, the display control unit 84 may display a predetermined message. The display control unit 84 may directly or indirectly display a notice indicating that driving for resolving slack of the transfer belt 11 is performed. In some examples, the display device 87 may be a liquid crystal display device.

The memory 85 may comprise a non-transitory computer readable medium that stores a program. The program may be executed by a processor. When the program stored in the memory 85 is executed by the processor, the function of the determination unit 82, the drive control unit 83, and the display control unit 84 may be realized by the processor.

Figure 12:
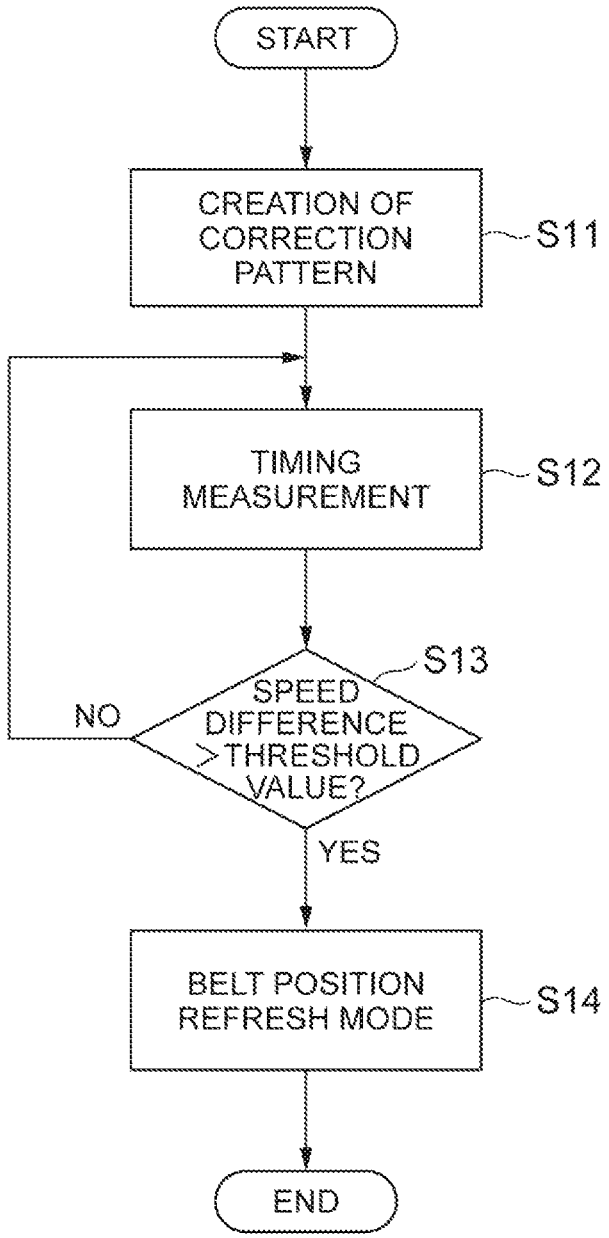
FIG. 12 is a flowchart illustrating an example operational flow of an imaging apparatus.

FIG. 12 is a flowchart illustrating an example operational flow of the imaging apparatus when slack occurs at a part of the transfer belt 11. In the example illustrated in FIG. 12, the printing process has been executed by the imaging apparatus 1, and a correction pattern is transferred to the transfer belt 11 by four image carriers 140 corresponding to respective colors of magenta, yellow, cyan, and black (operation S11). Transfer of the correction pattern with respect to the transfer belt 11 may be continuously executed with regular intervals. At operation S12, in the belt control mechanism 80, a detection timing of the correction pattern by the optical sensors 71L and 71R is measured by the optical sensors 71L and 71R, and the determination unit 82). At operation S13, the determination unit 82 determines whether or not a speed difference between the first end edge 11*a* side and the second end edge 11*b* side in the transfer belt 11 exceeds a predetermined threshold value on the basis of the timing at which the correction pattern is detected. In the event that the speed difference exceeds the threshold value, it is determined that slack occurs at the first end edge 11*a* or the second end edge 11*b*. On the basis of the determination, the belt drive device 100 drives the transfer belt 11 at the belt position refresh mode (operation S14). On the other hand, in a case where the speed difference does not exceed the threshold value, that is, in a case where the speed difference is equal to or less than the threshold value, the processing returns to a timing measurement of the correction pattern.

Figure 13:
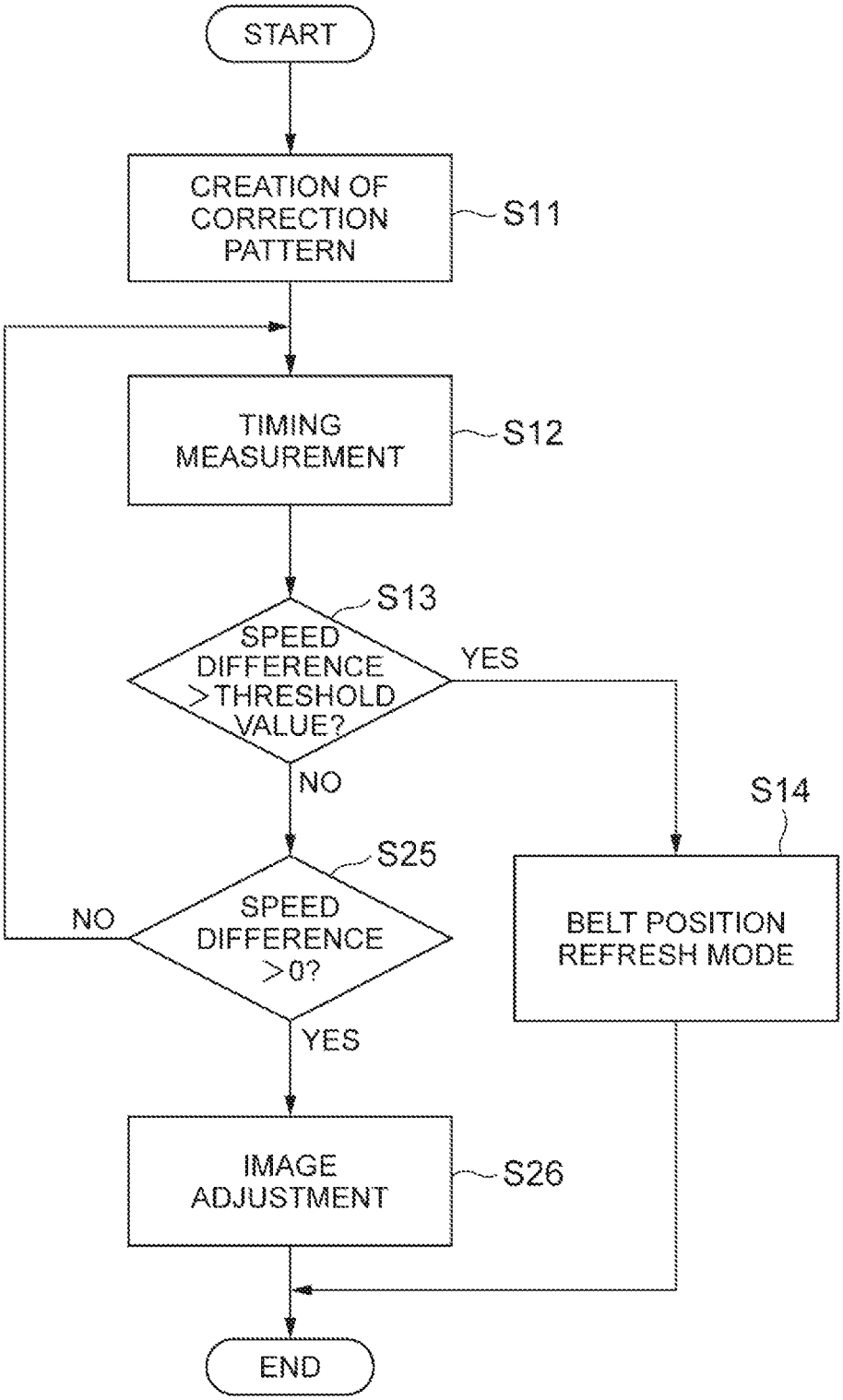
FIG. 13 is a flowchart illustrating another example operational flow of an imaging apparatus.

FIG. 13 is a flowchart illustrating another example operational flow of the imaging apparatus when slack occurs at a part of the transfer belt 11. In the example illustrated in FIG. 13, the operation S11 of creating a correction pattern, the operation S12 of measuring a detection timing of the correction pattern, the operation S13 of comparing the speed difference and the threshold value with each other, and the operation S14 of transitioning to the belt position refresh mode are similar to those in the example illustrated in FIG. 12. In the example illustrated in FIG. 13, in a case where it is determined in operation S13 that the speed difference exceeds the threshold value, it is further determined that the speed difference is present (operation S25). In a case where it is determined that the speed difference is not present, the processing returns to the timing measurement of the correction pattern. Furthermore, a state in which the speed difference is not present as in operation S25 is a state in which slack does not occur in the transfer belt 11. In some examples, even when the speed difference is present between the right and left sides, if the speed difference is relatively small to a certain extent at which slack does not occur in the transfer belt 11, the speed difference between the right and left sides may be understood to be substantially zero, and a determination may be made as "the speed difference is not present". As an example, a value near zero may be set as a threshold value to determine whether or not the speed difference is present. On the other hand, where it is determined that the speed difference is present, that is, in a case where slack is slight but is nonetheless present in the transfer belt 11, the image adjustment is executed (operation S26).

In the example image adjustment, right and left balance of the toner image that is transferred to the transfer belt 11 may be adjusted. That is, right and left balance of the electrostatic latent image that is formed on the surface of the image carrier 140 by the exposure unit 142 may be adjusted. In some examples where the speed difference occurs between the first end edge 11*a* and the second end edge 11*b*, a difference in a movement distance occurs between the first end edge 11*a* and the second end edge 11*b*. Accordingly, at an end edge at which a rotational speed is slow (that is, at an end edge at which slack occurs), an image becomes longer in a movement direction in comparison to an end edge in which the rotational speed is fast. Accordingly, the right and left balance of the electrostatic latent image may be adjusted so that an image of the end edge on the slow rotational speed side becomes shorter in the movement direction in comparison to an end edge on the fast rotational speed side by a degree corresponding to the speed difference.

In some examples, when occurrence of slack in the transfer belt 11 is detected, control is performed by the controller 81 so that the primary transfer roller 27 is separated from the transfer belt 11. In some printing processes, the transfer belt may be in a state of being pressed or engaged between the primary transfer roller and the image carrier, and slack that occurs in the transfer belt may be less likely to be resolved. However, for the example imaging apparatus 1 in a state in which the primary transfer roller 27 is separated from the transfer belt 11, the transfer belt 11 enters a free state between the idler rollers 25 and 26 in which slack is likely to occur. In addition, tension of an end edge on a side in which slack occurs is lowered, and thus the tension roller 22 returns to the original position. According to this, the slack of the transfer belt 11 is resolved.

In the example imaging apparatus, control for separating the primary transfer roller 27 from the transfer belt 11 is performed, and thus the transfer belt 11 can enter a free state over a wide range.

In the example imaging apparatus 1, slack of the transfer belt 11 is detected by the pair of optical sensors 71L and 71R. The optical sensors 71L and 71R are not in contact with the transfer belt 11, and the transfer belt 11 may be prevented from being subjected to excessive stress when detecting slack. In some examples, the correction pattern that is detected by the optical sensors 71L and 71R can be used in color registration control, and a detector for detection of the slack can also be used as a detector for control of the color registration.

In the example imaging apparatus 1, slack may be detected on the basis of a speed difference between the first end edge 11*a* and the second end edge 11*b* of the transfer belt 11. Speed detection of the transfer belt 11 may be correlated or associated with detection of slack, and thus detection of slack may be indirectly realized. In some examples, the speed difference is detected on the basis of detection of the correction pattern. For example, the speed difference related to slack can be obtained on the basis of the detection timing of the correction pattern and the like.

In addition, in the example imaging apparatus 1, when the speed difference is equal to or less than a threshold value, the right and left balance of the toner image may be adjusted. In some examples where slack that occurs in the transfer belt 11 is slight, image formation can be executed without stopping the printing process.

It is to be understood that not all aspects, advantages and features described herein may necessarily be achieved by, or included in, any one particular example. Indeed, having described and illustrated various examples herein, it should be apparent that other examples may be modified in arrangement and detail.

For example, a mechanism that is separated from the transfer belt 11 in the example imaging apparatus, may be formed by the secondary transfer roller 133. In this case, when slack occurs in the transfer belt 11, the secondary transfer roller 133 may be separated from the transfer belt 11 instead of the primary transfer roller 27 or in addition to the primary transfer roller 27.

By way of further example, a mechanism that is separated from the transfer belt 11 may be formed by the cleaning member 172. In this case, when slack occurs in the transfer belt 11, the cleaning member 172 may be separated from the transfer belt 11 instead of the primary transfer roller 27 or in addition to the primary transfer roller 27.

The invention claimed is:

1. An imaging system comprising:

an endless belt;

a tensioning system to apply tension to the endless belt;

a contact member to engage with the endless belt;

a detector to detect slack at a part of the endless belt; and a controller to cause the contact member to be separated from the endless belt, wherein the slack of the endless belt is reduced in response to the contact member being separated from the endless belt.

2. The imaging system according to claim 1, wherein the contact member includes a transfer roller.

3. The imaging system according to claim 1, wherein the contact member includes a primary transfer roller.

4. The imaging system according to claim 1, wherein the contact member includes a secondary transfer roller.

5. The imaging system according to claim 1, wherein the contact member includes a cleaning member that cleans a surface of the endless belt.

6. The imaging system according to claim 1, wherein the endless belt includes a first end edge and a second end edge that is opposite to the first end edge, and wherein the detector includes a pair of optical sensors to detect a state of the first end edge and the second end edge in a non-contact manner.

7. The imaging system according to claim 6, wherein the detector is to detect the slack of the endless belt based on a speed difference between a rotational speed of the first end edge and a rotational speed of the second end edge.

8. The imaging system according to claim 7, wherein the detector is to detect the speed difference based on detecting a correction pattern that is formed at the first end edge and the second end edge of the endless belt.

9. The imaging system according to claim 8, wherein the detector is to detect the speed difference by deriving the speed difference based on detecting a timing of a plurality of correction patterns which are formed along a rotational direction of the endless belt.

10. The imaging system according to claim 8, wherein the correction pattern is a correction pattern that is used in color registration control.

11. The imaging system according to claim 10, wherein the controller is to execute the color registration control based on a state of the correction pattern that is detected by the detector.

12. The imaging system according to claim 7, wherein the endless belt comprises a transfer belt to receive a transferred toner image, wherein the controller is to cause the contact member to be separated from the endless belt in a case where the speed difference exceeds a predetermined threshold value, and wherein the controller is to adjust a right and left balance of the transferred toner image when viewed from a movement direction of the transfer belt in a case where the speed difference occurs and the speed difference is equal to or less than the predetermined threshold value.

13. The imaging system according to claim 1, wherein the tensioning system includes a drive roller and a tension roller, and wherein the imaging system further comprises a steering mechanism disposed between the drive roller and the tension roller.

14. The imaging system according to claim 13, wherein the endless belt includes a first end edge and a second end edge that are located on opposite sides of the endless belt from each other, and wherein the steering mechanism includes a steering roller to apply increased tension along the first end edge of the endless belt.

15. An imaging system, comprising:

a rotational endless belt that includes a first end edge and a second end edge that are located on opposite sides of the endless belt from each other;

a tensioning system that includes a drive roller and a tension roller, the tensioning system to apply tension to the endless belt;

a steering roller that is disposed between the drive roller and the tension roller to apply increased tension along the first end edge of the endless belt, the increased tension along the first end edge to cause slack to occur along the second end edge of the endless belt;

a primary transfer roller to engage with the endless belt;

a pair of sensors to detect a speed difference, which relates to the slack of the second end edge, between a rotational speed of the first end edge and a rotational speed of the second end edge; and a controller to control the primary transfer roller to be separated from the endless belt, in response to the detected speed difference, to reduce the slack of the endless belt.

16. An imaging system comprising:

an endless belt including a first end edge and a second end edge opposite to the first end edge, the endless belt to receive a transferred toner image;

a tensioning system to apply tension to the endless belt;

a contact member to engage with the endless belt;

a detector including a pair of optical sensors to detect a state of the first end edge and the second end edge in a non-contact manner to detect slack of the endless belt based on a speed difference between a rotational speed of the first end edge and a rotational speed of the second end edge; and a controller to cause the contact member to be separated from the endless belt in a case where the speed difference exceeds a predetermined threshold value and to adjust a right and left balance of the transferred toner image when viewed from a movement direction of the endless belt in a case where the speed difference occurs and the speed difference is equal to or less than the predetermined threshold value.

17. The imaging system according to claim 16, wherein the contact member includes a primary transfer roller.

18. The imaging system according to claim 16, wherein the tensioning system includes a drive roller and a tension roller, and wherein the imaging system further includes a steering mechanism disposed between the drive roller and the tension roller.

19. The imaging system according to claim 18, wherein the steering mechanism includes a steering roller to apply increased tension along the first end edge of the endless belt.

* * * * *